US007634212B2

(12) United States Patent
Asakawa

(10) Patent No.: US 7,634,212 B2
(45) Date of Patent: Dec. 15, 2009

(54) POSITION ADJUSTABLE CONTROL PANEL FOR IMAGE FORMING DEVICE

(75) Inventor: Yoshiyuki Asakawa, Kyoto (JP)

(73) Assignee: Kyocera Mita Corporation, Osaka (JP)

( * ) Notice: Subject to any disclaimer, the term of this patent is extended or adjusted under 35 U.S.C. 154(b) by 389 days.

(21) Appl. No.: 11/369,192

(22) Filed: Mar. 6, 2006

(65) Prior Publication Data

US 2006/0230689 A1 Oct. 19, 2006

(30) Foreign Application Priority Data

Mar. 15, 2005 (JP) ..... 2005-073666

(51) Int. Cl.
*G03G 15/00* (2006.01)

(52) U.S. Cl. ..... 399/107

(58) Field of Classification Search ..... 399/107, 399/81; 361/681

See application file for complete search history.

(56) References Cited

U.S. PATENT DOCUMENTS

2005/0226647 A1* 10/2005 Lee ..... 399/81

FOREIGN PATENT DOCUMENTS

| | | | |
|---|---|---|---|
| JP | 07234645 A | * | 9/1995 |
| JP | 11-119498 | | 4/1999 |
| JP | 2003-246114 | | 9/2003 |
| JP | 2004133243 A | * | 4/2004 |

* cited by examiner

*Primary Examiner*—David M Gray
*Assistant Examiner*—Andrew V Do
(74) *Attorney, Agent, or Firm*—The Webb Law Firm

(57) ABSTRACT

A control panel adapted to be attached to a main body of an image forming device is disclosed. The control panel has a plurality of positions with respect to the image forming device main body and comprises: a panel main body; a fixed member adapted to be fixed relative to the main body of the image forming device; a movable member movable between a first position wherein the movable member engages the fixed member to maintain the panel main body in a selected one of the plurality of positions and a second position, spaced from the first position in a first direction, wherein the movable member disengages the fixed member to allow movement of the panel main body; a control member operatively connected to the movable member and movable substantially in the first direction to move the movable member between the first position and the second position.

18 Claims, 8 Drawing Sheets

POSITION ADJUSTABLE CONTROL PANEL FOR IMAGE FORMING DEVICE

BACKGROUND OF THE INVENTION

The present invention is directed to a control panel, for an image forming device, whose position can be adjusted.

Such a control panel facilitates the use of the panel, for example, by a user in a standing position, and a user in a wheel chair.

A known and conventional position adjusting mechanism for a control panel has a position holding mechanism having a fixed member in the form of a bracket with a number of holes for a pin. The mechanism also has a movable member in the form of an engaging pin that can be inserted into one of the holes. As an operating member of the position holding mechanism is operated in an operating direction, the pin (movable member) is moved in a direction substantially perpendicular to the direction the operating member is operated, until the pin is inserted into one of the holes provided to the main body, whereby fixing the control panel in one position (See, for example, Publication 2003-246114 of Japanese Patent Application). Since the direction in which the pin (the movable member) moves is substantially perpendicular to the direction in which the operating member is moved in the conventional device disclosed in the patent document described above, there is room for improvement in that the conventional device required a mechanism to convert the direction of the operation into the perpendicular direction in which the pin needs to be moved.

SUMMARY OF THE INVENTION

The present invention was made to address this issue. The object of the invention is to provide a control panel improved over the conventional one.

To achieve this object, the control panel, in accordance with the present invention, which is adapted to be attached to a main body of an image forming device, and which has a plurality of positions with respect to the image forming device main body, comprises: a panel main body; a fixed member adapted to be fixed relative to the main body of the image forming device; a movable member movable between a first position wherein the movable member engages the fixed member to maintain the panel main body in a selected one of the plurality of positions and a second position, spaced from the first position in a first direction, wherein the movable member disengages the fixed member to allow movement of the panel main body; a control member operatively connected to the movable member and movable substantially in the first direction to move the movable member between the first position and the second position.

It is thus possible to provide a control panel without a direction converting mechanism that was necessary in the conventional device. This has additional advantage of alleviating the loss of operating force that occurred when changing the operating direction.

DETAILED DESCRIPTION OF PREFERRED EMBODIMENTS

Embodiments of the control panel of an image forming device with a position adjusting mechanism is described next with reference to the accompanying drawings. The word "pin" used throughout the present specification means a member that is able to engage with another object. A "pin" does not have to have a circular cross section and may have, for example, a polygonal, elliptic, or an irregularly shaped cross section if appropriate. In addition, a "pin" does not have to have a small diameter.

Examples of an image forming device includes, but not limited to, a photo copier, a printer, and a facsimile machine. While a photo copier is used in the present specification as an example of an image forming device, the present invention is applicable to any image forming devices. In the present specification, "front", "forward", or other similar word is associated with the direction indicated by the arrow F in FIG. 1 and "back", "rear" or other similar word is associated with the direction opposite to the direction indicated by the arrow F.

Figure 1:
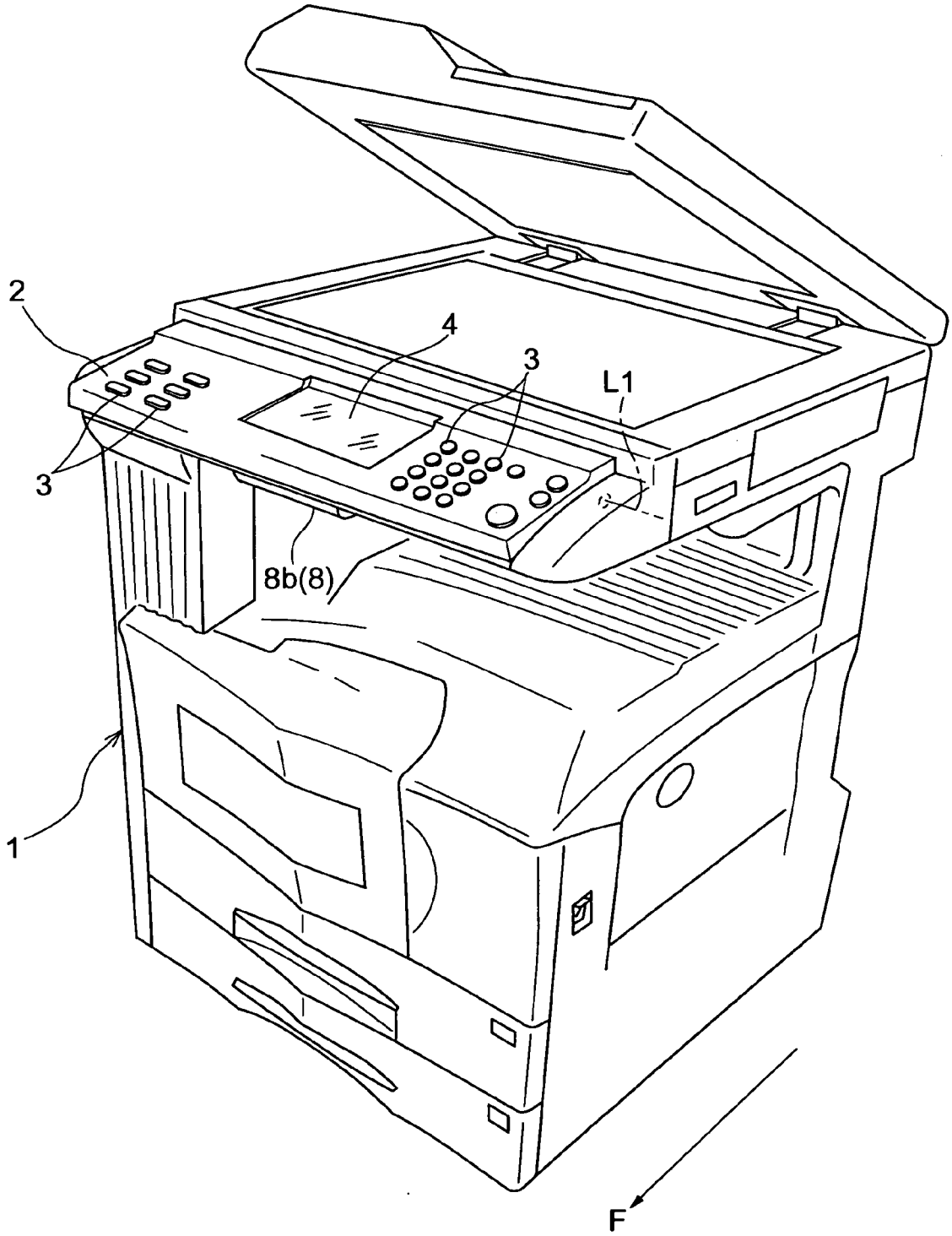
FIG. 1 shows a perspective view of a copier as an example of an image forming device in accordance with the present invention.
Figure 2:
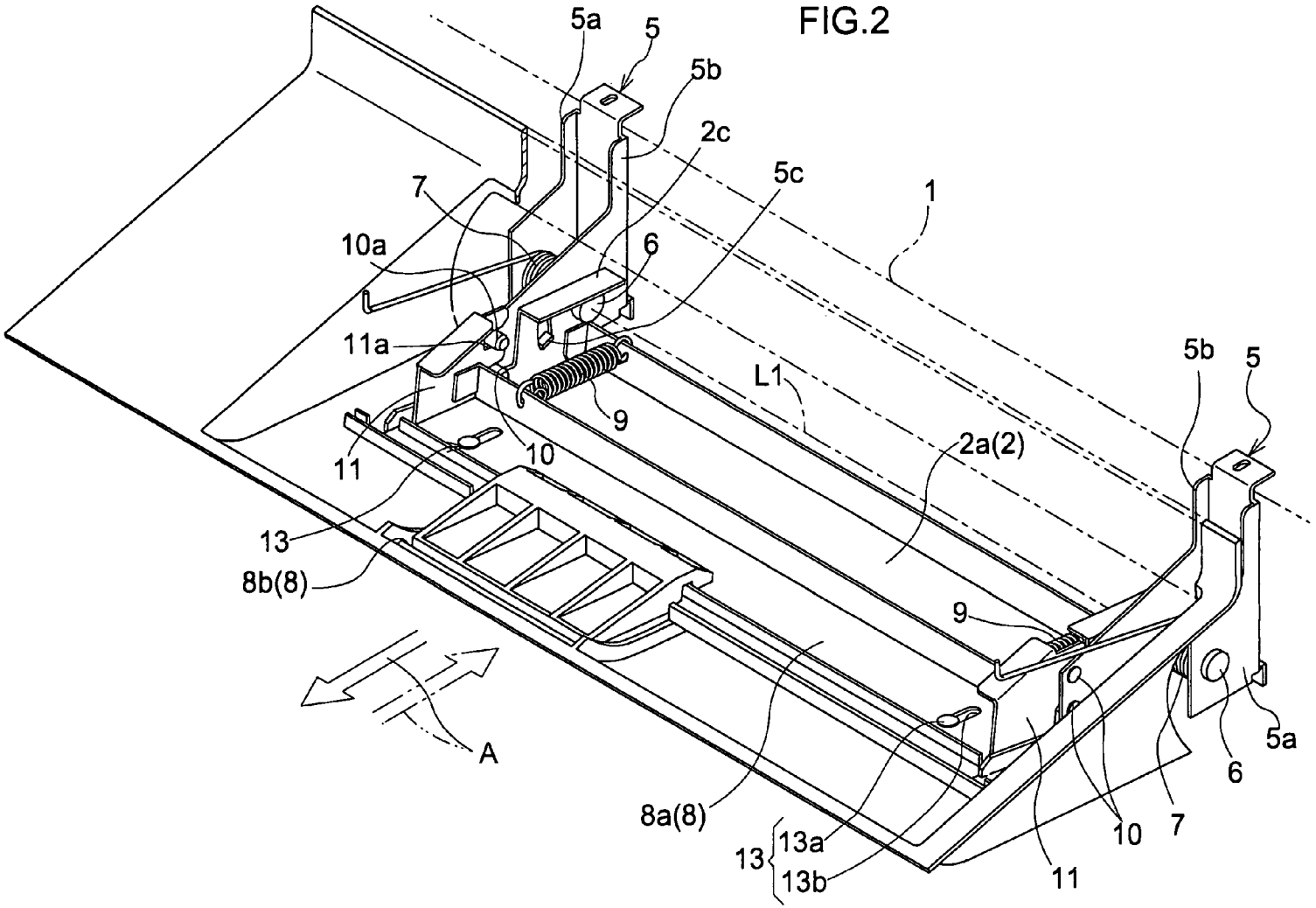
FIG. 2 shows a perspective view of; a part of the control panel in accordance with the present invention.
Figure 3:
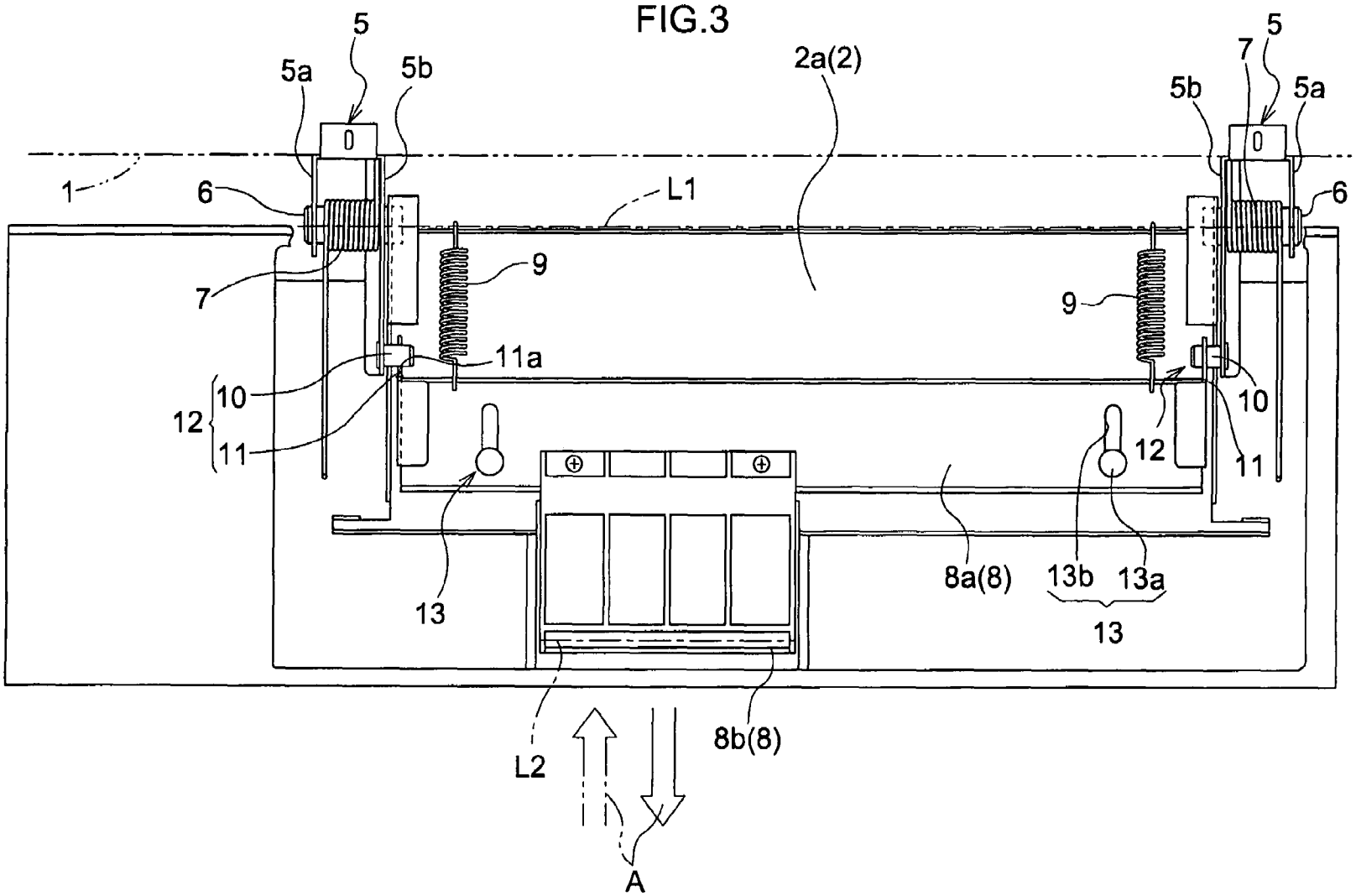
FIG. 3 shows a plan view of the part of the control panel shown in FIG. 2.
Figure 4:
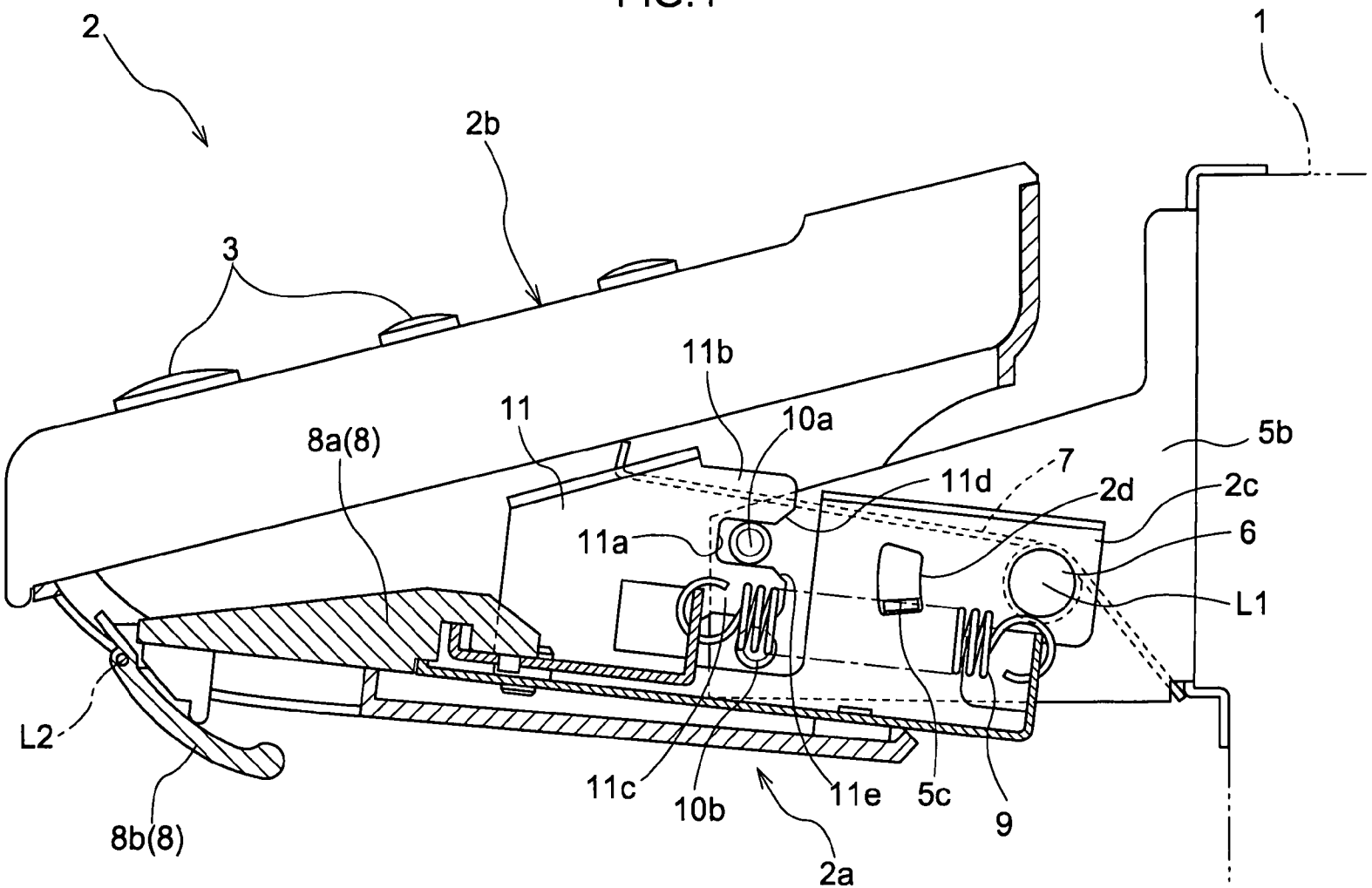
FIG. 4 shows a side view of the control panel.

As shown in FIG. 1, the a control panel 2 is positioned at a front and upper position of the main body 1 of the photo copier (sometimes referred simply to as a copier). As shown in FIGS. 2 to 4, the control panel 2 includes a panel main body 2*a* and a panel cover 2*b* attached to the upper surface of the panel main body 2*a*. Various control keys 3, such as a numeric pad, are provided on the panel cover 2*b*, i.e. the top surface of the control panel 2. In addition to the control keys 3, a liquid crystal display 4 is provided on the panel cover 2*b* in the present embodiment as shown in FIG. 1 to display various information. Various parts of the control panel 2 including the panel main body 2*a* and the panel cover 2*b* may be made of resin, with the exception of the urging springs described below. However, a part or the whole of each of these members may be made of metal.

A pair of forwardly projecting brackets 5 are fixed to the front surface of the main body 1 of the copier at locations that face the back of the control panel 2. Each of the brackets 5 has a pair of plate members 5*a* and 5*b*. A horizontally oriented lateral shaft 6 extends through the plate members 5*a* and 5*b*. Each lateral shaft 6 has a projecting portion that projects inwardly through the plate member 5*b* which is located more inwardly than the other plate member 5*a*. The panel main body 2*a* of the control panel 2 is mounted to the projecting portion through a vertical member 2*c* of the main body 2*a*. The lateral shaft 6 may be fixed to the panel main body 2*a*.

More specifically, the control panel 2 is mounted to the main body 1 of the copier such that it is rotatable about the lateral axis L1 of the lateral shaft 6 with respect to the main body 1, so that the angular position of the control panel 2 may be adjusted about the lateral axis L1. The control panel 2 is also urged by the coil springs 7 wound around the two lateral shafts 6 such that the front part of the control panel 2 is urged upwardly about the lateral axis L1.

A control member 8*a* is located on the upper surface of the panel main body 2*a*. The control member 8*a* is adapted to be movable in the operating direction shown at the arrow A in FIGS. 2 and 3 by means of the slide mechanism 13 that includes a pair of right and left slide pins 13*a* that project upwardly from the panel main body 2*a* and corresponding elongate slots 13*b* formed in the control member 8*a*. The operating direction is substantially horizontal in the present embodiment and is oriented toward the lateral axis L1. However, the operating direction of the present invention is not limited to this direction. A control lever 8*b* is mounted to the front part of the control member 8*a* so that the lever 8*b* can be rotated through a predetermined angle about the axis L2 which is substantially parallel to the lateral axis L1. The control member 8*a* is urged toward the copier main body 1 by means of a pair of the right and left coil springs 9 disposed between the control member 8*a* and the panel main body 2*a*.

Each of the right and left plate members 5*b* that project forwardly from the copier main body 1 has two pins 10*a* and 10*b* that project inwardly and extend substantially parallel to the lateral axis L1. The pins 10*a* and 10*b* function as a fixed member. A movable member 11 is integral with the control member 8*a* near right and left end positions of the control member 8*a*. The movable member 11 extends generally vertically and also in the forward-rearward direction. The movable member 11 has a pair of fingers 11*b*, 11*c* that generally extend in the forward-rearward direction and a recess 11*a* formed therebetween and facing one of the pins 10*a* and 10*b*. The movable member 11 with the fingers 11*b*, 11*c* and the recess 11*a* together with the pins 10*a* and 10*b* form the position holding mechanism 12. The recess 11*a* extends substantially horizontally and opens toward the lateral axis L1. The recess 11*a* has an upper edge that extends substantially horizontally and a lower edge that extends parallel to the upper edge. Each of the fingers 11*b*, 11*c* has a guide surface 11*d* or 11*e* for guiding the pin 10*a* or 10*b* to the recess 11*a*. The vertical height of each of the fingers 11*b*, 11*c* is slightly less than the distance between the two pins 10*a* and 10*b*. The vertical height of the recess 11*a*, that is, the spacing between the fingers 11*b* and 11*c*, is slightly greater than but substantially equal to the diameter of the pin 10*a* or 10*b*.

The control member 8*a* and the control lever 8*b* forms the control portion 8 of the position holding mechanism. More particularly, the movable member 11 with the recess 11*a* is adapted to move closer to or away from the copier main body 1 along the operating direction A. As the movable member 11 is moved toward the main body 1 by operating the operating member 8, the recess 11*a* engages either one of the two pins 10*a* and 10*b* in a direction substantially perpendicular to the direction the axis of either of the pins 10*a* and 10*b* extends. The angular position of the control panel 2 is thus maintained by the engagement of the pin 10*a* or 10*b* and the movable member 11.

To reverse the process, the movable member 11 is moved away from the copier main body 1 so that the pin 10*a* or 10*b* is no longer held in the recess 11*a*. Thus the recess 11*a* disengages the pin 10*a* or 10*b*, resulting in the release of the control panel 2 from the angular position.

Figure 6:
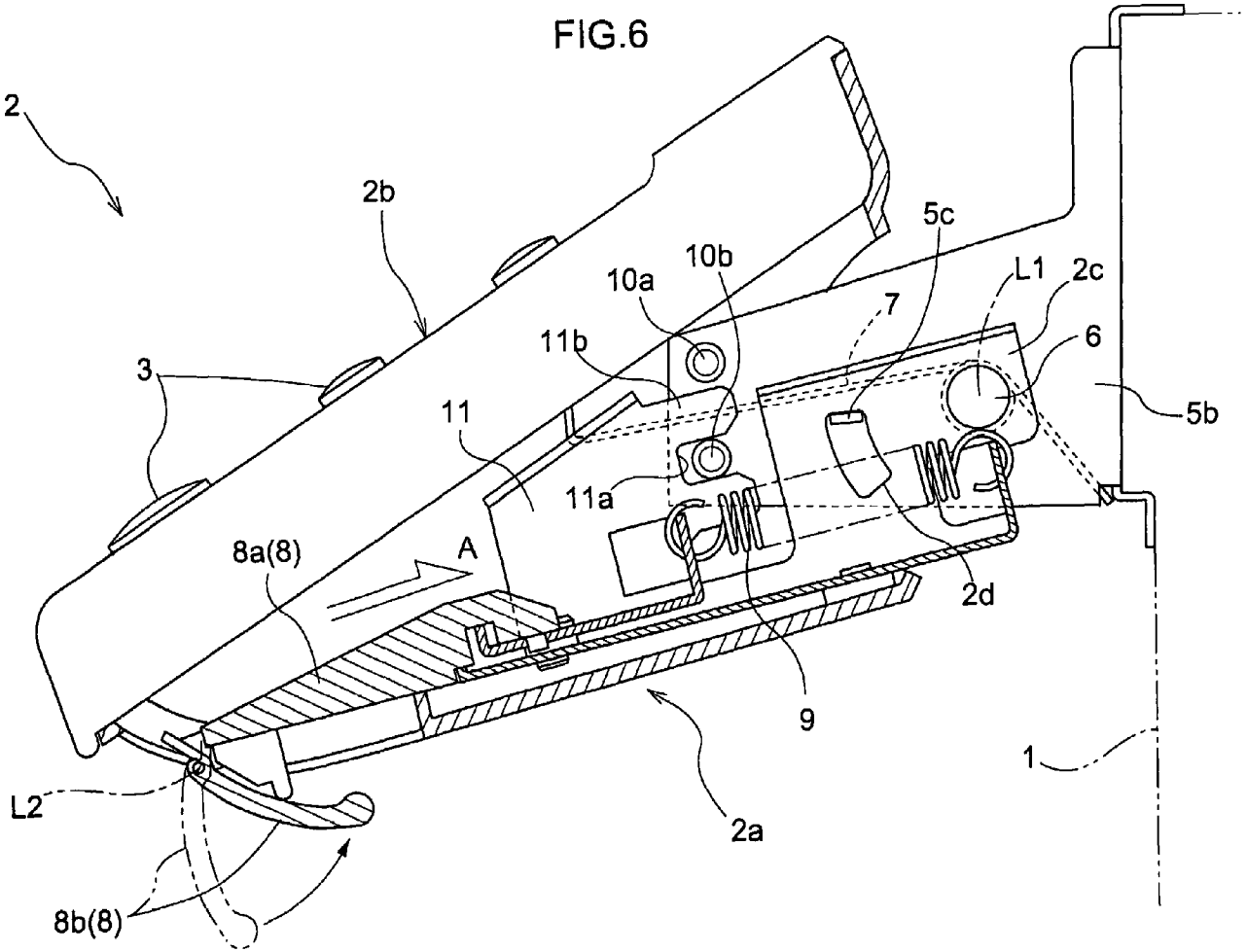
FIG. 6 shows a side view of the control panel.

A slot 2*d* is formed in each of the vertical members 2*c* of the panel main body 2*a*. The slot 2*d* generally forms an arc about the axis of the lateral shaft 6 and extends generally vertically. A horizontally extending projection 5*c* is formed in the plate member 5*b* at the position corresponding to the slot 2*d* for engaging the slot 2*d*. The projection 5*c* abuts against the lower end of the slot 2*d* when the control panel 2 is in the first angular position as shown in FIG. 4, whereas the projection 5*c* abuts against the upper end of the slot 2*d* when the control panel 2 is in the second angular position as shown in FIG. 6. Thus, the first and second angular positions are set by the abutment of the projection 5*c* against the lower end and the upper end of the slot 2*d* respectively.

The operation of the position adjusting mechanism of the control panel is described next.

Figure 5:
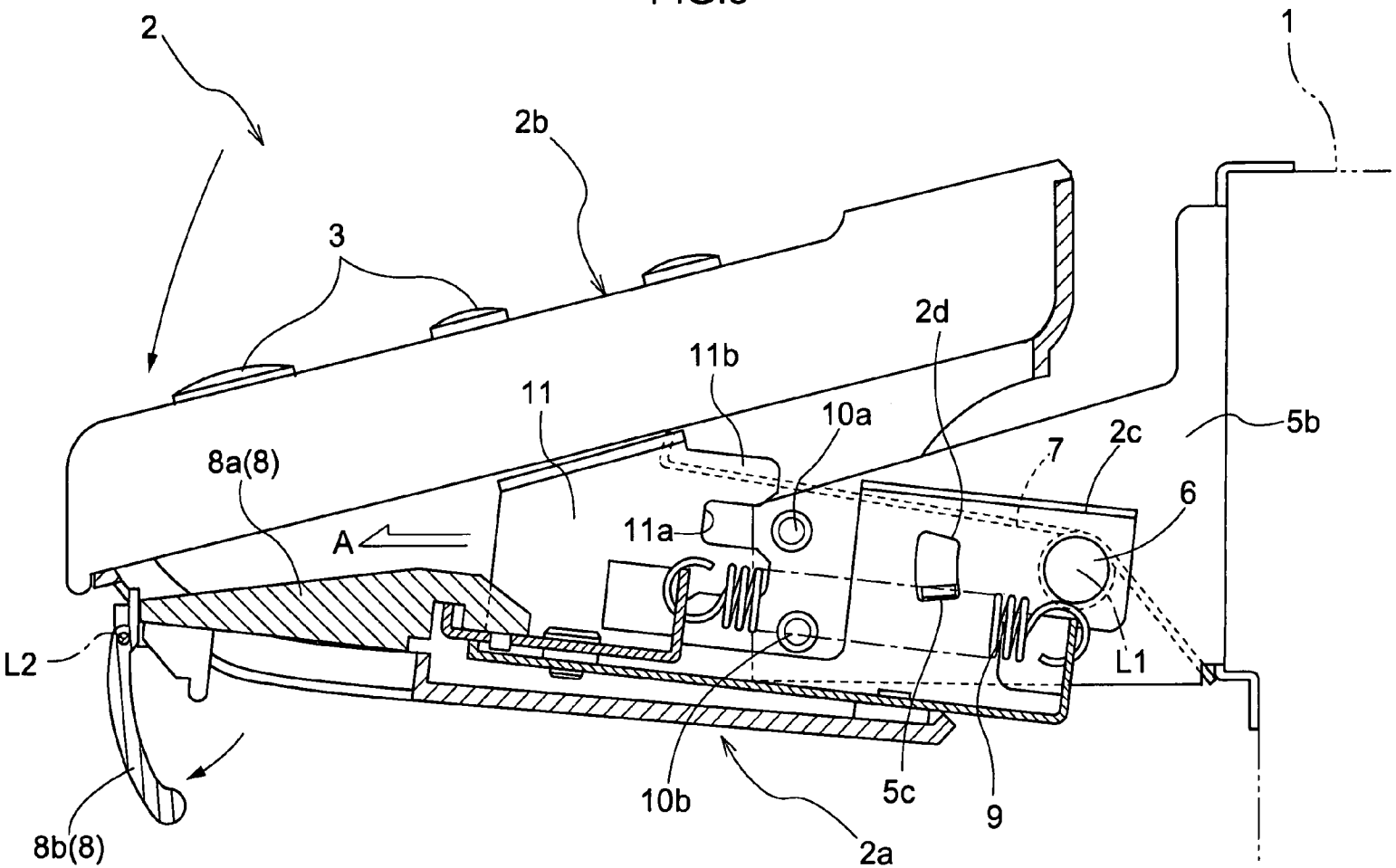
FIG. 5 shows a side view of the control panel.

To move the control panel 2 from its first angular position shown in FIG. 4 to its second angular position shown in FIG. 6, for example, the operator rotates the control lever 8*b* through a predetermined angle as shown in FIG. 5 and continues to pull it forward against the urging force of the coil springs 9. The control member 8*a* and the movable member 11 are then also moved away from the copier main body 1 with the control lever 8*b* along the operating direction A so that the upper pin 10*a* is no longer held in the recess 11*a*, thus releasing the control panel 2 from the angular position.

The control panel 2 is then rotated downwardly about the lateral axis L1. Subsequently, the operator releases the control lever 8*a*. This allows the control member 8*a* and the movable member 11 to be moved toward the copier main body 1 along the operating direction A by the urging force of the coil springs 9. The lower pin 10*b* then comes to be held in the recess 11*a* of the movable member 11, thus holding the control panel 2 in its second angular position as shown in FIG. 6.

Moving the control panel 2 from the second angular position shown in FIG. 6 to the first angular position shown in FIG. 4 is accomplished in a similar manner. The control lever 8*b* is pulled forwardly. However, because of the urging force of the springs 7 that urges the front part of the control panel 2 upwardly, the panel 2 is moved upwardly automatically and is stopped at the appropriate position. Thus, the control panel 2 does not have to be pushed up. Thus all the operator has to do is to release the control lever 8*b*. The movable member 11 is then moved toward the copier main body 1 by the urging force of the coil springs 9 until the upper pin 10*a* comes to be held in the recess 11*a* of the movable member 11, thus holding the control panel 2 in the angular position shown in FIG. 4.

The mechanism described above allows the control panel 2 to be held or maintained in two angular positions. However, it is, of course, possible to hold the control panel 2 at three or more positions by increasing the number of the pins correspondingly.

Since the pin 10*a* or 10*b* is firmly held in the recess 11*a* of the movable member 11 by the abutment of the upper and lower edges of the pin 10*a* or 10*b* against the recess 11*a* in any of the angular positions, the control member 2 is securely maintained at a desired angular position.

Figure 7:
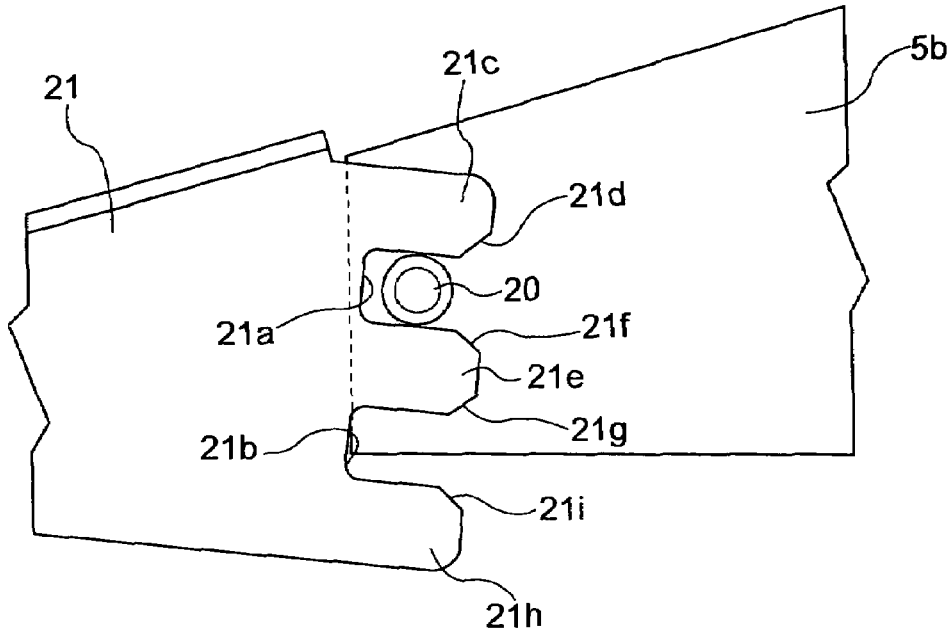
FIG. 7 shows a side view of an engaging area of the control panel in accordance with a different embodiment of the present invention.

OTHER EMBODIMENTS (1) As shown in FIG. 7, it is possible to define a plurality of angular positions of the control panel 2 by providing a corresponding number of recesses 21*a* and 21*b* and a single pin 20. While the movable member 21 of this embodiment has two recesses, it is possible to provide three or more recesses as necessary. The fingers 21*c*, 21*e*, 21*h* have guide surfaces 21*d*, 21*f*, 21*g*, 21*i*.

Figure 8:
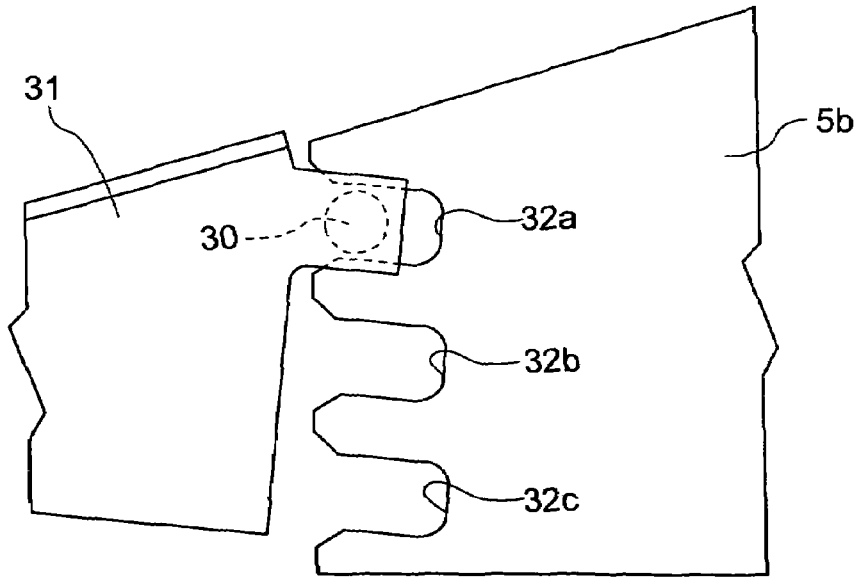
FIG. 8 shows a side view of an engaging area of the control panel in accordance with a further embodiment of the present invention.

(2) In the first embodiment, the position maintaining mechanism includes the pins 10*a* and 10*b* as well as the movable member 11 having a recess 11*a*, with the pins 10*a* and 10*b* provided to the member on the copier main body 1 side and the recess 11*a* formed in the control member 8 of the position maintaining mechanism. However, as shown in FIG. 8, a plurality of recesses 32*a*, 32*b*, 32*c* may be formed in the bracket (main body 1 side) while the single engaging pin 30 may be provided to the movable member 31. It is also possible to form one recess in the bracket and to provide a plurality of pins in the movable member.

The position maintaining mechanism does not have to be a pin and recess arrangement. Various other arrangement may be used in such a mechanism utilizing mutually engaging members.

Figure 9:
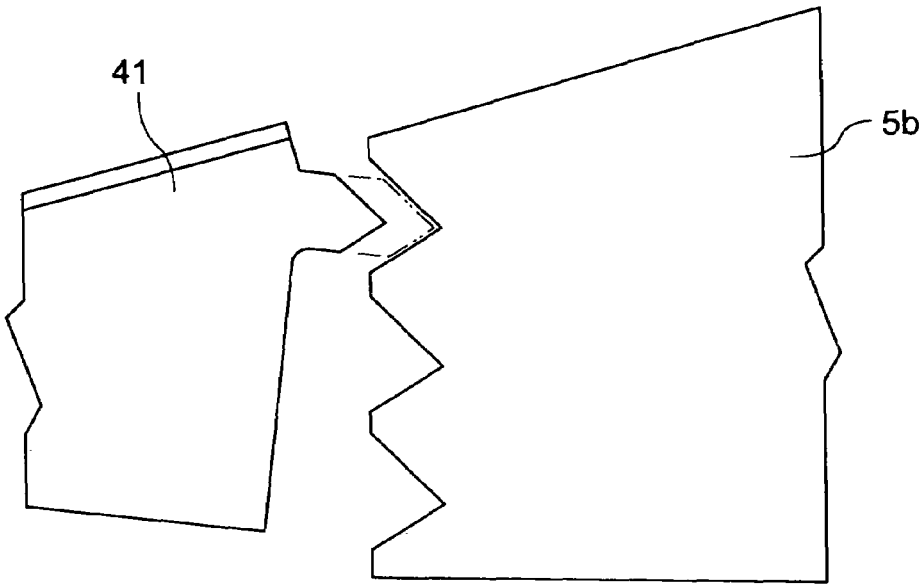
FIG. 9 shows a side view of an engaging area of the control panel in accordance with a further embodiment of the present invention.
Figure 10:
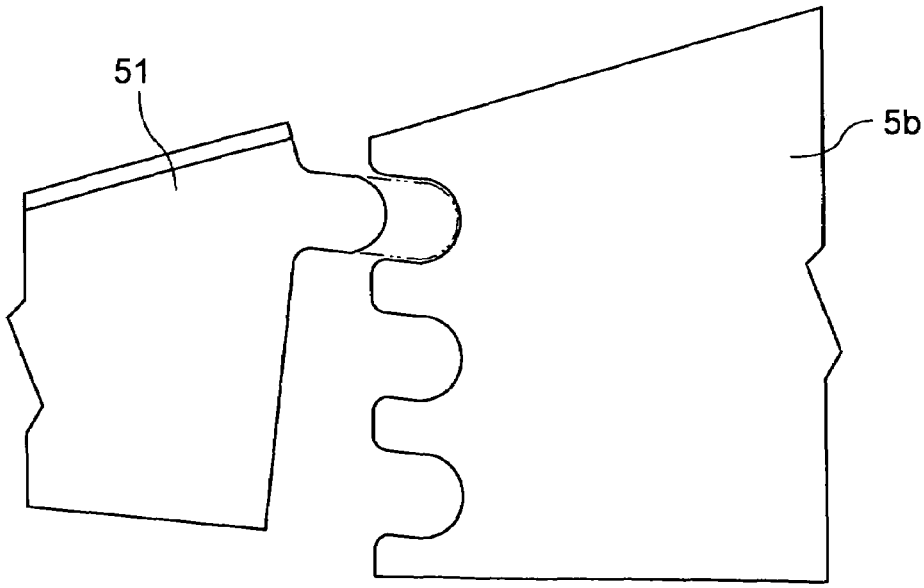
FIG. 10 shows a side view of an engaging area of the control panel in accordance with a further embodiment of the present invention.

For example, FIG. 9 shows a movable member 41 having an engaging portion with sloped surfaces and a fixed member 5*b* having correspondingly shaped engaged portions having sloped surfaces. FIG. 10 shows a movable member 51 having an engaging portion with a round surface and a fixed member 5*b* having correspondingly shaped engaged portions. It is possible to provide the fixed member with the engaging portion while providing the movable member with the engaged portions. A movable member and fixed members may have engaging surfaces that are shaped differently than the ones shown above.

(3) While the operating portion 8 of the position maintaining mechanism is provided on the control panel 2 in the previous embodiments, the operating portion 8 may be mounted to the copier main body 1. In addition, while the movable member 11 is provided integrally with the control portion 8 in the embodiments described above, another member or members may be placed between the control portion 8 and the movable member 11.

(4) On bracket and one lateral shaft may be used to rotatably support the control panel 2 instead of a pair of brackets 5 and a pair of lateral shafts 6.

What is claimed is:

1. A control panel attached to a main body of an image forming device, the control panel having a plurality of positions with respect to the image forming device main body, the control panel comprising:

a panel main body;

a bracket fixed to the main body of the image forming device;

a first lateral shaft provided between the bracket and the panel main body to allow the control panel to pivot among the plurality of positions;

a fixed member fixed relative to the main body of the image forming device;

a movable member movable between a first position wherein the movable member engages the fixed member to maintain the panel main body in a selected one of the plurality of positions and a second position wherein the movable member is positioned in a radial direction of the first position relative to the first lateral shaft and disengages the fixed member to allow movement of the panel main body; and a control member operatively connected to the movable member and movable substantially along the radial direction to move the movable member between the first position and the second position;

wherein one of the fixed member and the movable member has a plurality of pins that extend substantially parallel to an axis of the first lateral shaft and that correspond to the plurality of positions, and wherein the other of the fixed member and the movable member has a recess that engages one of the pins from a direction substantially perpendicular to an axis of the pin.

2. A control panel as defined in claim 1, wherein the control member is movably mounted to the panel main body and wherein the movable member is integrally mounted to the control member.

3. A control panel as defined in claim 1, wherein the plurality of pins are aligned substantially vertically.

4. A control panel as defined in claim 1, further comprising:

a first urging spring provided between the control member and the panel main body for urging the movable member in the first direction.

5. A control panel as defined in claim 1, further comprising:

a second urging spring having one end abutting the control panel and another end abutting the bracket for urging the control panel upwardly.

6. A control panel as defined in claim 1, wherein the fixed member has the plurality of pins, and the recess is formed in the movable member, and wherein the movable member has a plurality of fingers with the recess formed therebetween.

7. A control panel as defined in claim 6, wherein a vertical height of each of the fingers is slightly less than the distance between the plurality of pins.

8. A control panel as defined in claim 6, wherein each of the fingers has a guide surface for the plurality of pins.

9. A control panel as defined in claim 1, wherein the first direction is substantially horizontal.

10. A control panel as defined in claim 1, further comprising:

a panel cover fixed to the panel main body and control keys positioned on an upper surface of the panel cover.

11. A control panel attached to a main body of an image forming device, the control panel having a plurality of positions with respect to the image forming device main body, the control panel comprising:

a panel main body;

a bracket fixed to the main body of the image forming device;

a first lateral shaft provided between the bracket and the panel main body to allow the control panel to pivot among the plurality of positions;

a slot formed in one of the panel main body and the bracket, wherein the slot has an upper end and a lower end and extends generally vertically;

a projection formed in the other of the panel main body and the bracket and inserted into the slot, wherein the projection abuts the upper end of the slot when the control panel is in one of the plurality of positions and abuts the lower end of the slot when the control panel is in another of the plurality of the positions;

a fixed member fixed relative to the main body of the image forming device;

a movable member movable between a first position wherein the movable member engages the fixed member to maintain the panel main body in a selected one of the plurality of positions and a second position wherein the movable member is positioned in a radial direction of the first position relative to the first lateral shaft and disengages the fixed member to allow movement of the panel main body; and a control member operatively connected to the movable member and movable substantially along the radial direction to move the movable member between the first position and the second position.

12. A control panel as defined in claim 11, further comprising:

a first urging spring provided between the control member and the panel main body for urging the movable member in the first direction.

13. A control panel as defined in claim 11, further comprising:

a second urging spring having one end abutting the control panel and another end abutting the bracket for urging the control panel upwardly.

14. A control panel as defined in claim 11, wherein the radial direction is substantially horizontal.

15. A control panel as defined in claim 11, further comprising:

a panel cover fixed to the panel main body and control keys positioned on an upper surface of the panel cover.

16. A control panel attached to a main body of an image forming device, the control panel having a plurality of positions with respect to the image forming device main body, the control panel comprising:

a panel main body;

a bracket fixed to the main body of the image forming device;

a first lateral shaft provided between the bracket and the panel main body to allow the control panel to pivot among the plurality of positions;

a fixed member fixed relative to the main body of the image forming device;

a movable member movable between a first position wherein the movable member engages the fixed member to maintain the panel main body in a selected one of the plurality of positions and a second position wherein the movable member is positioned in a radial direction of the first position relative to the first lateral shaft and disengages the fixed member to allow movement of the panel main body;

a control member operatively connected to the movable member and movable substantially along the radial direction to move the movable member between the first position and the second position; and a control handle attached to the control member such that the control handle is pivotable with respect to the control member about a second lateral shaft that is substantially parallel to an axis of the first lateral shaft.

17. A control panel as defined in claim 16, wherein the radial direction is substantially horizontal.

18. A control panel as defined in claim 16, further comprising:

a panel cover fixed to the panel main body and control keys positioned on an upper surface of the panel cover.

* * * * *

UNITED STATES PATENT AND TRADEMARK OFFICE

CERTIFICATE OF CORRECTION

PATENT NO. : 7,634,212 B2
APPLICATION NO. : 11/369192
DATED : December 15, 2009
INVENTOR(S) : Yoshiyuki Asakawa It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 673 days.

Signed and Sealed this

Ninth Day of November, 2010

David J. Kappos

David J. Kappos
*Director of the United States Patent and Trademark Office*